United States Patent [19]

Darby

[11] 4,373,302

[45] Feb. 15, 1983

[54] SHARPENING APPARATUS FOR CIRCULAR BLADES

[76] Inventor: Emory C. Darby, P.O. Box 853, Covington, Ga. 30209

[21] Appl. No.: 207,338

[22] Filed: Nov. 17, 1980

[51] Int. Cl.[3] ..... B24B 3/36

[52] U.S. Cl. ..... 51/131.1; 51/247

[58] Field of Search ..... 51/131.1, 132, 267, 51/247; 83/823

[56] References Cited

U.S. PATENT DOCUMENTS

| | | | |
|---|---|---|---|
| 468,535 | 2/1892 | Mallon | 51/132 |
| 570,110 | 10/1896 | Terry | 51/267 |
| 684,362 | 10/1901 | Flora | 51/131.1 |
| 1,055,182 | 3/1913 | Joyce | 83/823 |
| 2,656,738 | 10/1953 | Tomlin | 51/247 |
| 2,815,619 | 12/1957 | Brownley | 51/247 |
| 2,879,633 | 3/1959 | Gage | 51/247 |

*Primary Examiner*—Harold D. Whitehead
*Attorney, Agent, or Firm*—Newton, Hopkins & Ormsby

[57] ABSTRACT

A bench-mounted sharpener apparatus for large diameter comparatively narrow width circular blades, such as a slitter blade, that includes a gear motor for turning a blade at a steady comparatively slow speed of rotation. A grinding wheel to form a precision beveled edge on one side of the blade at a time is driven at a comparatively high speed of rotation by a motor fixed to an adjustable slide which may be moved laterally, longitudinally and angularly to achieve a desired angle of bevel with precision. An adjustable blade stabilizer attached to the slide prevents flexure of the blade away from the grinding wheel during the sharpening operation by contact with the outer face of the turning blade near its periphery. A separate blade diameter sizing grinder is provided on the bench and a blade cooling liquid container is attached to the bench.

1 Claim, 5 Drawing Figures

SHARPENING APPARATUS FOR CIRCULAR BLADES

BACKGROUND OF THE INVENTION

Many types of circular blade sharpeners are known in the prior art. These vary widely in relative complexity and cost. A particular need exists for a precision sharpener for large diameter comparatively narrow width circular blades, such as those used to slit thermal insulation, such blades measuring up to 22 inches in diameter and being quite thin and frequently having slits around their circumferences. These large comparatively narrow width blades are inherently difficult to sharpen with precision. It is the objective of this invention, therefore, to provide a simplified and very efficient precision sharpening apparatus for circular blades of this type which heretofore have resisted precision sharpening by known devices in the prior art. The apparatus is sturdy and durable and fully adjustable to enable the formation on the large blade of a double bevel cutting edge of high precision at any chosen angle.

The present invention provides a sharpening apparatus for blades of the above type in unit form for attachment to a work bench with the blade and sharpening grinding wheel positioned in a highly convenient manner. The apparatus may include a separately bench-mounted blade diameter sizing grinder and a cooling trough containing cooling water for the blade during the sharpening operation. Simplicity and economy of construction are features of the invention.

Other objects and advantages of the invention will become apparent during the course of the following description.

DETAILED DESCRIPTION

Figure 1:
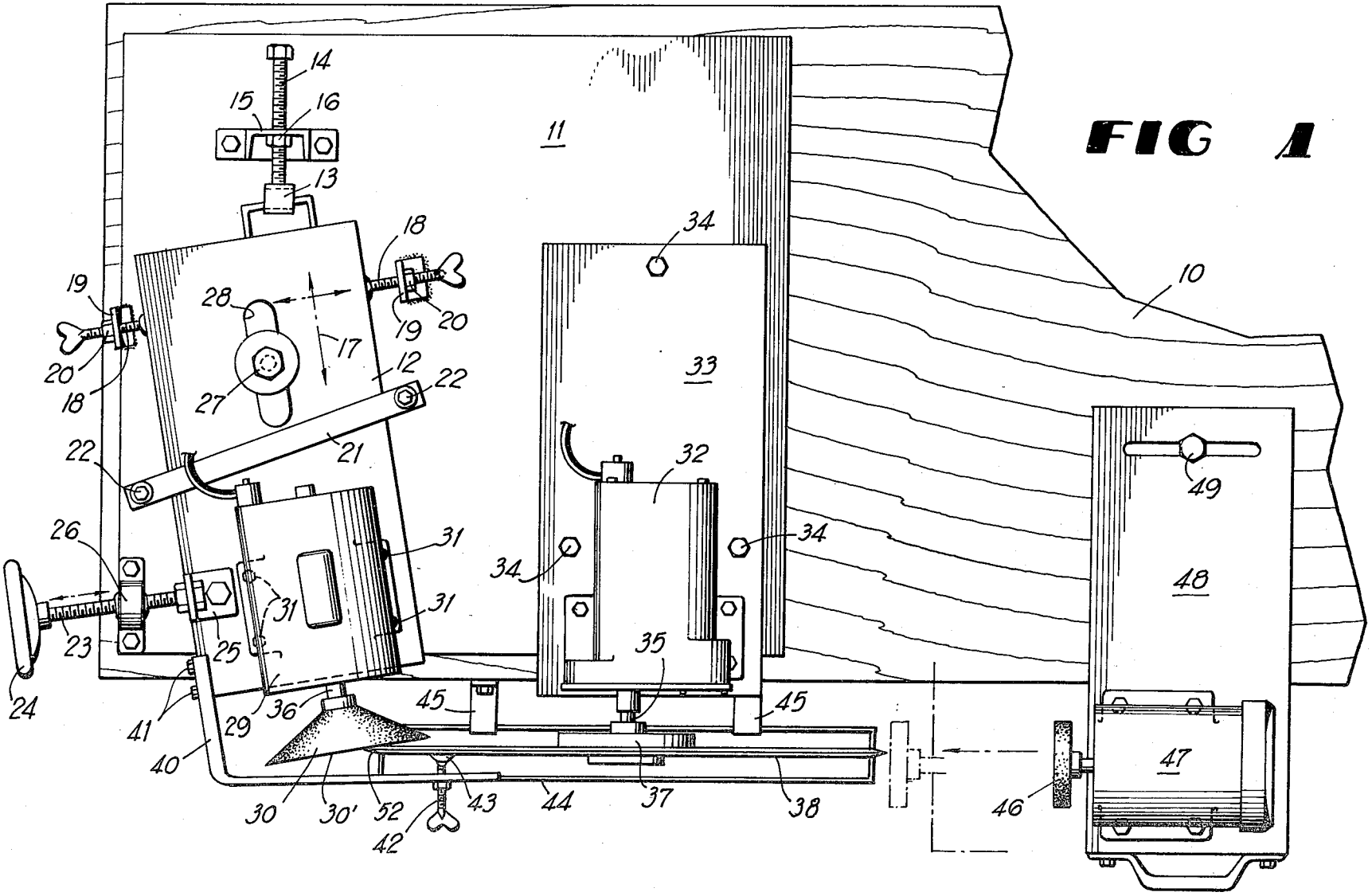
FIG. 1 is a plan view of a sharpening apparatus for circular blades according to the invention.
Figure 2:
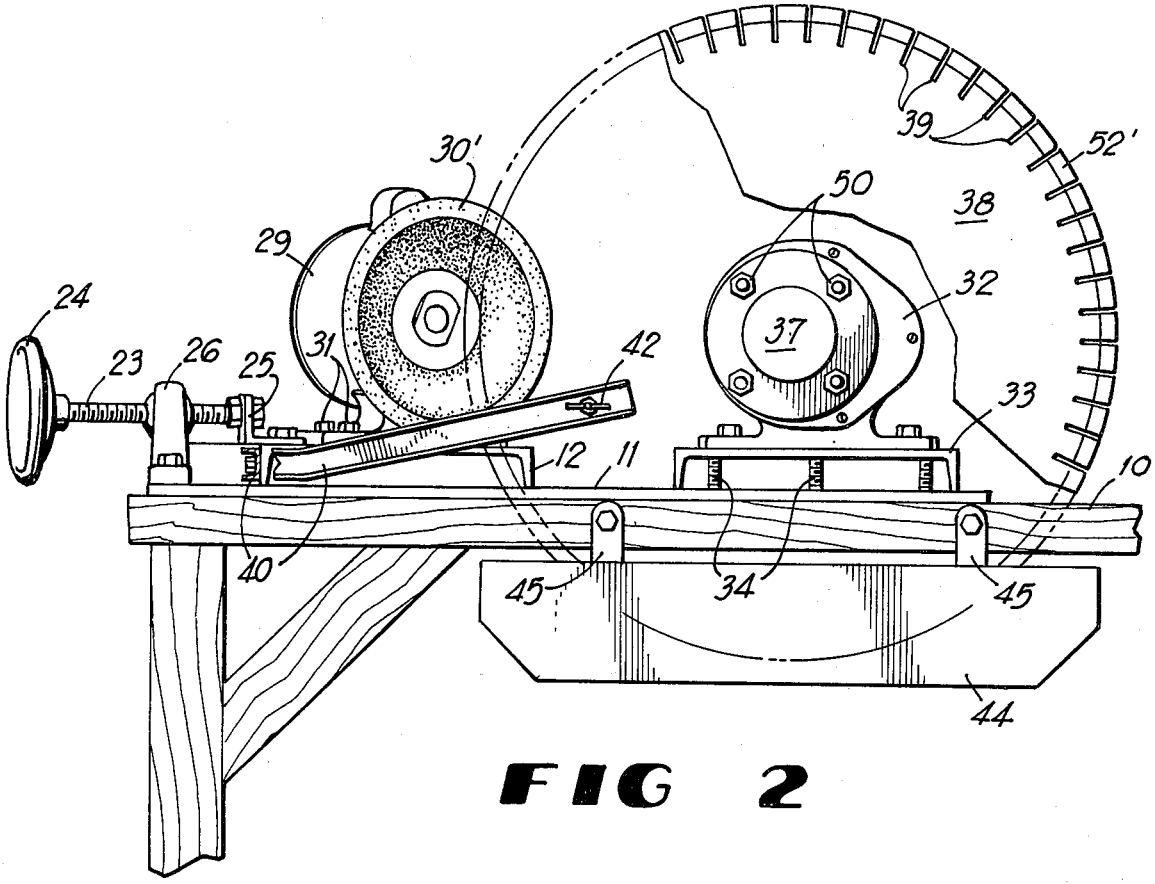
FIG. 2 is a front elevational view of the apparatus.
Figure 3:
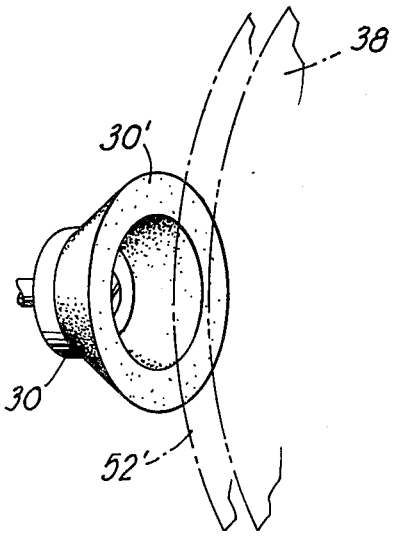
FIG. 3 is a fragmentary perspective view showing a cup-like grinding wheel employed in the apparatus.

Referring to the drawings in detail wherein like numerals designate like parts, the numeral 10 designates a horizontal work bench on which the blade sharpening apparatus is fixedly mounted. The apparatus comprises a steel bed plate 11 fixed to the bench 10 in any desired manner near one edge of the bench. A slide 12, such as a rigid channel member, is attached adjustably to the bed plate 11 so that several different adjustments can be achieved. The rear end of the slide 12 is connected through a coupling 13 with an adjusting screw 14 held in a bracket 15 on the bed plate 11, the screw 14 having a locking nut 16. The screw 14 is used to adjust the slide 12 in a longitudinal direction indicated by the direction arrow 17. Near the rear end of the slide, a pair of opposite side adjusting screws 18 held in brackets 19 and carrying lock nuts 20 engage the edges of the slide and are employed to adjust its rearward end laterally. The slide is held down upon the bed plate 11 by a generally transverse hold-down bar 21 anchored by bolts 22 to the bed plate.

Near its forward end, the slide 12 is rendered angularly adjustable by a screw 23 having a hand wheel 24 and connected to one side of the slide through a bracket 25. A ball swivel nut within a bearing 26 attached to the bed plate 11 enables lateral adjustment of the slide at its forward end. The slide pivots around an anchor bolt 27 near and forwardly of its rear end, such bolt having a loose fit within a longitudinal guide slot 28.

An electrical drive motor 29 for a cup-like conical grinding wheel 30 is fixedly attached at 31 to the slide 12, the wheel projecting forwardly of the bench 10. The motor 29 drives the grinding wheel 30 at a relatively high rotational speed such as 1725 RPM.

A gearmotor 32 spaced laterally of the motor 29 is attached fixedly to a mounting plate 33, in turn bolted as at 34 to bed plate 11. A driven shaft 35 of gear motor 32 has an axis which converges forwardly with the axis of the driven shaft 36 of motor 29. A disc or hub 37 driven by the shaft 35 at a steady comparatively slow rotational speed, such as 30 RPM, mounts the large circular blade 38 undergoing sharpening in the apparatus. This blade may have a diameter of about 20 to 30 inches or more and a thickness of about ¼ inch at the center of the blade which gradually tapers to ⅛ inch near its outer diameter where it is sharpened to a knife edge bevel on both sides. Its periphery may have multiple radial slits 39 that are spaced about one inch apart and having a depth of approximately ½ inch. The blade, due to its comparative narrow width must be stabilized in accordance with an important feature of the invention.

The blade stabilizing means comprises a rigid arm 40 attached at 41 to one forward corner of the slide 12 and extending forwardly of the grinding wheel 30 and blade 38 and generally radially across the blade in spaced parallel relationship thereto. Near its free end, the arm 40 carries an adjustable screw 42 having a shoe 43 adapted to contact the outer face of blade 38 so as to stabilize the blade under the sharpening pressure exerted on it by the grinding wheel 30.

During the blade sharpening process, a lower sector of the blade 38 turns in a cooling bath contained within a trough 44 suspended by tabs 45 from one edge of the work bench 10.

A portable grinding wheel 46 is provided for grinding the diameter of the blade 38 to a proper size prior to sharpening it by means of the wheel 30. The grinding wheel 46 is driven by a motor 47 attached to a base plate 48 secured for convenience to the bench 10 by a single bolt 49.

Figure 4:
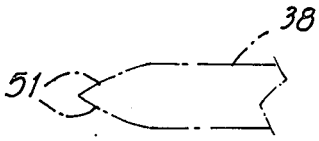
FIGS. 4 and 5 are fragmentary views showing the profile of the circular blade edge before and after sharpening.

The sharpening apparatus is used in the following manner. The circular blade 38 requiring sharpening is attached to the hub 37 releasably by screws 50. The dull beveled faces of blade 38 are depicted at 51 in FIG. 4.

Figure 5:
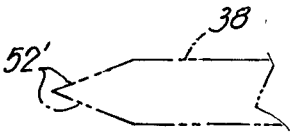

The slide 12 on which the sharpening wheel 30 is bodily mounted is adjusted laterally, lengthwise and angularly to bring the annular end face 30' of the cup-like grinding wheel into engagement with the blade 38 at precisely the correct angle to the plane of the blade 38. This establishes the correct bevel angle for the blade undergoing sharpening. The adjustable blade stabilizing screw 42 is adjusted to bring its shoe 43 into firm contact with the side face of the blade 38 away from the grinding wheel 30. This stabilizes the rotating blade 38 and prevents deflection thereof under the pressure of the sharpening wheel 30. The gear motor 32 and motor 29 are now activated after all preliminary adjustments have been made and the correct bevel 52', FIG. 5, is quickly produced at a precision angle on one side of the blade 38. If need be, during the sharpening process, the slide 12 can be fed forwardly by use of the screw 41 without changing the angle of the slide.

Upon completion of the bevel 52' on one side of the blade 38, the blade is reversed on the hub 37 and a second identical bevel 52' is produced on the other side of the blade in the manner described.

The apparatus is characterized by simplicity and ease and convenience of operation. It sharpens with high precision large diameter comparatively narrow width blades which are difficult to control during the sharpening process.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A self-contained sharpening apparatus for sharpening thin circular blades of large diameter and being bodily mountable on a work bench, the apparatus comprising a flat base plate mountable on a support surface of a work bench, a gear motor including a mounting plate secured to said base plate near one side thereof and having a driven shaft turning at a comparatively low speed of rotation and projecting beyond one edge of the base plate, means carried by the driven shaft to releasably secure a large diameter thin circular blade thereto for rotation with the shaft for sharpening, a comparatively high speed drive motor having a mounting base forming a slide, the drive motor having a driven shaft and a cone grinding wheel secured to such shaft for comparatively high speed rotation therewith and having a frontal grinding face, screw-threaded adjusting means on the base plate and engaging the slide to move the slide laterally, longitudinally and angularly with respect to the rotational axis of the grinding wheel, whereby the frontal grinding face of such wheel can be precisely adjusted to a required acute angle to the plane of rotation of the circular blade, the frontal grinding face extending across the peripheral edge of the circular blade on the side of the blade nearest to the gear and drive motors and exerting pressure on the blade edge sufficient to produce grinding and sharpening of the blade edge, means on said base plate and engaging the slide to lock the slide fixedly in a selected adjusted position, an arm fixed to the slide near one forward corner thereof and spaced from one side of the drive motor and grinding wheel, the arm extending forwardly of the grinding wheel and circular blade and having a lateral extension across and spaced from the frontal grinding face of the wheel and the forward face of the circular blade, an adjustable and lockable screw-threaded circular blade stabilizing shoe carried by the lateral extension of the arm substantially at right angles to the rotational plane of the blade, and said shoe slidably engaging the forward face of the blade near and radially inwardly of the peripheral edge of the blade in opposing relationship to the forward grinding face of the grinding wheel.

* * * * *